US008662586B2

(12) United States Patent
Serber

(10) Patent No.: US 8,662,586 B2
(45) Date of Patent: Mar. 4, 2014

(54) DYNAMICALLY BALANCED SEAT ASSEMBLY HAVING INDEPENDENTLY AND ARCUATELY MOVABLE BACKREST AND METHOD

(76) Inventor: Hector Serber, San Rafael, CA (US)

( * ) Notice: Subject to any disclaimer, the term of this patent is extended or adjusted under 35 U.S.C. 154(b) by 490 days.

(21) Appl. No.: 11/973,914

(22) Filed: Oct. 10, 2007

(65) Prior Publication Data

US 2008/0100121 A1 May 1, 2008

Related U.S. Application Data

(60) Provisional application No. 60/828,944, filed on Oct. 10, 2006.

(51) Int. Cl.
*A47C 1/032* (2006.01)

(52) U.S. Cl.
USPC ..... 297/316; 297/318; 297/320

(58) Field of Classification Search
USPC ..... 297/316, 320, 301.1, 318
See application file for complete search history.

(56) References Cited

U.S. PATENT DOCUMENTS

| | | | | |
|---|---|---|---|---|
| 6,109,694 | A * | 8/2000 | Kurtz | 297/320 |
| 6,685,267 | B1 * | 2/2004 | Johnson et al. | 297/316 X |
| 6,695,404 | B2 * | 2/2004 | Bruske | 297/316 X |
| 6,709,058 | B1 * | 3/2004 | Diffrient | 297/320 |
| 8,272,692 | B1 * | 9/2012 | Epperson | 297/316 |

FOREIGN PATENT DOCUMENTS

DE 4239548 A1 * 4/1993

* cited by examiner

*Primary Examiner* — Anthony D Barfield

(57) ABSTRACT

A seat assembly 21 including a seat 22, a backrest 23 and a mounting assembly 24 mounting the seat 22 in a near horizontal orientation for movement along an upwardly concaved arcuate seat path having a center of curvature 37 proximate the center of mass 39 of a person seated on the seat, and mounting assembly 24 further mounting the backrest 23 in a near vertical orientation for movement independently of the seat along a forwardly concaved arcuate path having a center curvature 37 proximate the center of mass 39 of the person. An adjustment assembly 61 is provided for adjusting the radius of curvature of the path of motion of the backrest 23. Also provided are a backrest tilt adjustment assembly 71, an armrest adjustment assembly 90, a seat biasing assembly 110 and a seat motion latching assembly 111. A method of self-adjusting support and alignment of a backrest also is disclosed.

12 Claims, 14 Drawing Sheets

DYNAMICALLY BALANCED SEAT ASSEMBLY HAVING INDEPENDENTLY AND ARCUATELY MOVABLE BACKREST AND METHOD

CROSS-REFERENCES TO RELATED APPLICATIONS

This application claims the benefit of U.S. Provisional Patent Application No. 60/828,944 filed Oct. 10, 2006, entitled DYNAMICALLY BALANCED SEAT HAVING INDEPENDENTLY AND ARCUATELY MOVABLE SEAT AND BACKREST AND METHOD.

This applicant inventor was granted U.S. Pat. No. 7,234,775 B2 in 2007. This patent is related to the present application wherein claim 1 was granted representing a special case of the supporting structure design. An important object of the present application is to incorporate the design of several other supporting structures invented to produce the intended and desired motion. A general concept claim is required since there are several supporting structures with different component design and mechanical function configurations that can produce the desired counter balancing motion. A more general claim is presented in this application to replace the special case of the U-Shaped hanging cradle supporting the seat cushion by an all under the seat mechanism with arcuate rails and sliders and rollers. In the present invention the desired motion is obtained with supporting structures that are different in structure and mechanical function relative to the special case indicated in U.S. Pat. No. 7,234,775 B2.

BACKGROUND OF THE INVENTION

1. Invention

The field of the present invention relates, in general, to seat assemblies of the type commonly found in office and living environments, and more particularly, to seat assemblies having adjustable mechanisms with movable seats and movable backrests and methods for supporting the occupant thereon.

Further, it relates to seat assemblies that add the self-adjusting dynamic mechanisms to follow the users movements and balancing the weight with the supporting counter balanced action of the mechanism during use.

2. Description of Related Art

Considerable work has been directed toward the development of seat assemblies or chairs which are ergonomically well suited for use by persons who are engaged in tasks that require that they be seated for prolonged periods of time. Typical of such applications are the seats or chairs which are used in offices or at home for tasks such as typing, reading and computer use.

In recent years it has been recognized that it is highly desirable for such seat assemblies or chairs to be constructed in a manner which allows the seat to move along an upwardly concaved arcuate path, or some approximation thereof. Such arcuate movement is most desirably implemented by mounting the seat for movement about an arcuate path having a center of curvature which is proximate the center of mass of the person seated on the seat. This geometry dynamically balances the bio-mechanics of user's body with movement of the chair so that the user can have a plurality of equilibrium positions in a variety of postures. The design principle is one of counterbalanced motion in which the mass of the user's body is counterbalanced by angular forces of the motion of the seat mechanism in primarily a fore-and-aft direction.

People are accustomed to conventional static seat technology and the subjective perception that it is stable. Seating advancements to date deal with ergonomic concerns, cushion contouring, and tilt adjustments that typically are unstable unless locked in place. Such chairs are not responsive to the body's motion. For example, the low back and thighs lose support when the buttock slides forward on the seat by any small amount. This makes the seat unsafe as well as uncomfortable.

My previous U.S. Pat. Nos. 5,244,252; 5,460,427; 5,558,399, and 5,735,574, describe in more detail the advantages of mounting a seat for movement along an upwardly concaved path having a center of curvature proximate the center of mass of the person seated on the seat. These patents are incorporated herein by reference. Such seat assemblies also are particularly well suited for use in vehicles to dissipate the dynamic forces generated when the vehicle is involved in a sudden deceleration or crash.

In addition to mounting the seat of a chair for arcuate movement, it is also well known to mount the back of the seat assembly for movement or for movement of a portion of the back, such as the lumbar support region. Various schemes for moving the back are also disclosed in my above-referenced patents. Most of these movable back mounting systems couple the back to the seat and have been designed primarily for dynamic deceleration of the seat assembly in vehicles, but they are usable to varying degrees in office or home seating.

U.S. Pat. Nos. 5,261,732; 5,366,269; 5,437,494; 5,577,802; 5,961,073; 5,979,984, 6,334,648, and 7,234,775 disclose chairs or seat assemblies in which one or both of the back and seat are mounted for movement. It is important to note that differences in the manners in which the seats and/or seat backs are mounted for movement make the dynamic performance of these assemblies vastly different, even though there are superficial similarities. It is not enough to observe that movable seat and/or seat backs are known in the prior art.

By way of example, U.S. Pat. No. 5,261,732 to Hosoe, includes both a movable seat and movable seat back. It is clear, however, that the seat back in the Hosoe patent seat can move along an arcuate path, but the seat back in the Hosoe can only move vertically. There is a lever coupled between the seat and seat base in Hosoe which constrains motion seat back. The lever in Hosoe synchronizes seat motion with the height adjustment mechanism and thereby stops independent, free rotation of the user's pelvis by stopping the seat when the height is set.

In the present invention, unlike prior art such as Hosoe, the seat and the seat back are mounted for independent motion so that many, many independent equilibrium positions can be achieved for support in various seating postures and during the change between said postures.

It is, of course, also well known in office chairs to provide for backrest reclining mechanisms as, for example, are shown in U.S. Pat. Nos. 5,975,634 and 6,086,153. Seat and Backrest adjustments designed to be locked during use alone are not the same as a seat and a seat back which are mounted for independent movement during use.

Generally, therefore, there still remains a need for a chair or seating assembly which can be used for long periods of time that has an independently movably seat and an independently movable backrest which will together accommodate a wide range of seating postures while providing many balanced or equilibrium positions matched to the bio-mechanics of the user's body. Thus, the person using the chair will want to assume various postures, such as a forward reaching posture (where the person is performing manual tasks on a support surface such as a desk), or an erect posture (for tasks such as typing), or a semi-reclined posture for increased relaxation. The seat and backrest should be independently movable to an equilibrium position about which dynamic micro-adjustments of the user's body and the seat assembly about the center of mass of the user are possible in order to provide the greatest comfort during prolonged use.

A similar example of a chair assembly which has both a movable seat and a movable backrest is disclosed in U.S. Pat. No. 6,523,898 to Ball et al. In the Ball et al. patent, the seat assembly is mounted for arcuate movement along a path having a center of rotation below, not above, the seat. Thus, the seat moves about a combination of pivot points, which are below the seat, and the resulting path of seat motion is downwardly concaved. This can be very clearly seen in Ball et al. by comparing numeral 53 in FIG. 5 with numeral 53 in FIG. 7. The front of the seat in Ball et al. dives or rotates downwardly about a center of rotation which is below the seat and proximate the center post. The desired upwardly concaved arcuate path, which has been found to be desirable to achieving equilibrium of motion for many seat postures, is not present, therefore, in Ball et al. Instead, a seat motion which rotates the seat downwardly is present.

BRIEF SUMMARY OF THE INVENTION

The chair mechanism of the present invention is designed to match the motion of the body with the motion of the seat to allow the body to relax safely. It is a goal of the present mechanism to self-adjusts to an optimum position maintaining support without the need for manual adjustments at every instance of posture change. It is a further goal to accommodate the range of motion of the seated body with the present mechanism function of the seat and back.

According to one embodiment, the seat assembly of the present invention is comprised, briefly, of a seat, a backrest and a mounting assembly mounting the seat in a near horizontal orientation for fore-and-aft independently of the backrest movement along an upwardly concaved arcuate seat path having a center of curvature above the seat proximate the center of mass of a person seated on the seat. The seat mounting assembly further mounts the backrest in a near vertical orientation for movement independently of the seat along a forwardly concaved arcuate backrest path having a center of curvature in front of the backrest, above the seat and proximate the center of mass of the person seated on the seat. In addition, the downward motion of the backrest is opposed and balanced by spring forces that are sufficient to maintain equilibrium against the gravitational force to maintain the recline angle of the seated person stable at the desired position. The center of curvature of the seat path and the center of curvature of the backrest path may or may not be concentric depending on the back depth adjustment methods cited in each case presented as can be seen in FIGS. 1, 6, and 7. The seat assembly can also be fitted to mount the seat for fore-and-aft tilting to included an adjustment assembly formed to enable adjustment of the radius of curvature of the backrest path of motion without changing the relative positions of centers of curvature of the seat and backrest. An armrest adjustment mechanism may also be used.

The method of self-adjusting support and alignment of a person seated on the present seat assembly comprised, briefly, of the steps of mounting a seat for pivoting independently of the backrest about an axis above the seat and proximate the center of mass of the user seated on the seat; and mounting the backrest to pivot or rotate independently of the seat about an axis positioned in front of the backrest, above the seat, and proximate the center of mass of the user.

According to the embodiment in FIG. 1, the present invention is a seat assembly including a base assembly, a seat mounting assembly for mounting a seat to the base assembly, and a backrest mounting assembly for mounting a backrest to the base assembly. The seat mounting assembly mounts the seat to the base assembly in a near horizontal orientation for fore and aft movement along an upwardly concave arcuate tracking support under the seat having a center of curvature that is located over and above the seat and below the headrest. The backrest mounting assembly mounts the backrest to the base assembly in a near vertical orientation for movement independent of the seat and along an upwardly concave arcuate track having a center of curvature over and above the seat. The backrest mounting assembly is mounted to the base assembly below the seat.

A novel Backrest height adjustment assembly is presented and located on the mid back of the Backrest. This functions to raise or lower the Backrest to the desired height and lock in to the Backrest upright support structure for movement therewith.

In addition to the dynamic self-adjusting properties of the invention, it is a further object of the invention to provide a Backrest and Seat depth manual adjustment knob that has several positions that adjusts the horizontal distance from the lumbar support to the front edge of the seat.

The armrest height adjustment assembly with control is on the lower inside of the armrest. Turn to adjust arm height up or down.

The Backrest has a manual adjustment assembly that will adjust the angle of the Backrest relative to the Backrest mounting assembly.

Self-Adjusting Range of Positions of the Present Invention

The goal of the Present Invention is to facilitate essential body motion while sitting with mid range continuous support through the body's motions, maintaining the neutral posture between upright and reclined seated positions. The Dynamic Seat design seeks equilibrium and is self-adjusting, maintaining proper seat and lumbar support. The support surfaces come to rest and hold the posture to reduce muscle and bone stress where the body stops to either to work or relax.

The Dynamic Seat Backrest design matches the motion of the body with the motion of the Backrest and Seat. The back and lumbar support, as well as the seat, adjusts automatically to maintain proper support to the lumbar as the body changes posture.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The seat assembly of the present invention employs a mounting assembly which allows the seat to move independently along an upwardly concaved arcuate path having a center of rotation above the seat and proximate the center of gravity of the user or person seated on the seat. This center of rotation for the seat is broadly known in the prior art, as indicated above, and enables the user to periodically adjust the seat position while maintaining the mass of the user centered and balanced in equilibrium on the seat for various arcuate positions. The present chair assembly also employs a backrest which is movable, independently of the seat, about a similar center of rotation as the set, located above the seat and forward the backrest and more preferably about the center of gravity of a user seated on the seat. The movement of the backrest affords further balanced comfort for extended seat assembly use.

Figure 1:
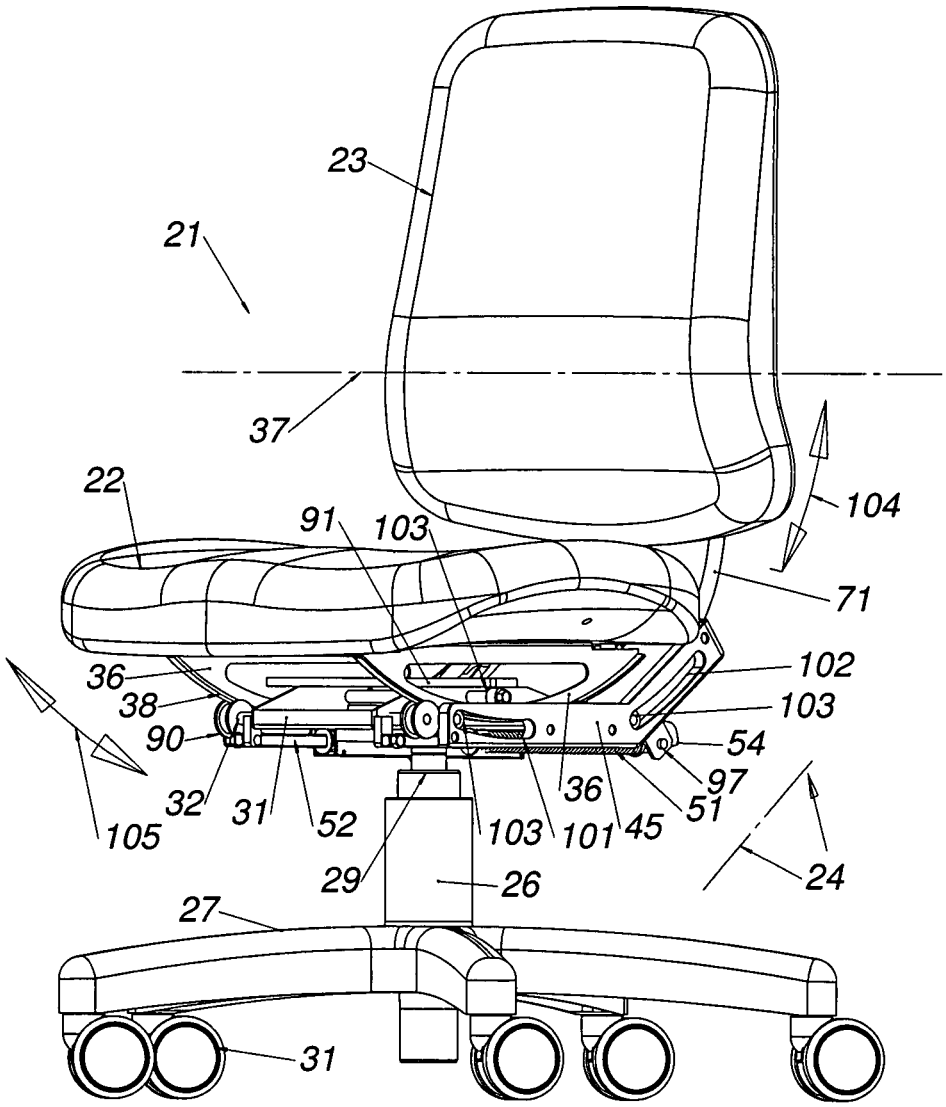
FIG. 1 is a front perspective view of a seat assembly constructed in accordance with the present invention.

Referring to FIG. 1, the chair or seat assembly of the present invention, generally designated 21, can be seen to include a seat 22 and backrest 23 that are supported above a support surface by a mounting assembly, generally designated 24. Seat mounting assembly 24 can include a conventional vertically adjustable, telescope-type, pedestal 26 which is rollingly supported by a plurality of roller elements 28 mounted to radially extending legs 27, which elements are conventional and well known in the art. It also should be noted that other supporting structures can be substituted for pedestal 26. For example, the seat assembly of the present invention can be mounted to standard 3 or 4 legged bases.

In the embodiment shown in the drawings, mounting assembly 24 also includes a base support housing 31 mounted on top of pedestal 26, which housing has fixed axles 32 on which arcuate seat pan 36 is mounted. Seat 22 is moveably mounted to arcuate seat pan cradle 36 positioned on top of rollers 90 at each corner of housing 31 and pivoted thereto at pivot axis 37 proximate the center of lumbar motion located above the seat and in front of the backrest. Arcuate seat pan cradle 36 can include a seat mounting plate 38 to which seat 22 can be fastened.

While the illustrated embodiment employs a cradle having a center of curvature above the seat, it will be understood that the same arcuate, upwardly concaved seat path can be produced by mounting the seat on an arcuate, upwardly concaved track and supporting the seat on the track by rollers or sliding supports. The method of supporting the seat relative to the seat mounting hardware is not critical to the broad statement of the invention which only requires independent movement of the seat along an upwardly concaved arcuate path, whether a pivoted cradle or track support with rollers or glides is employed.

In the improved seating assembly of FIG. 1, mounting assembly 24 further mounts backrest 23 in a near vertical orientation for movement independently of seat 22 along a forwardly concaved arcuate path having a center of curvature in front of the backrest, above the seat, and proximate the center of mass 39 of the person seated on the seat. Most preferably, the center of curvature of the arcuate backrest path is coincident or concentric with the center of curvature 37 for the arcuate seat path. Arcuate back pan 45 rigidly supports upright structural member 71 and is provided with guiding slots 101 and 102 that roll on rollers 103 to produce said arcuate backrest motion 104.

Figures 2, 2A, 2B:
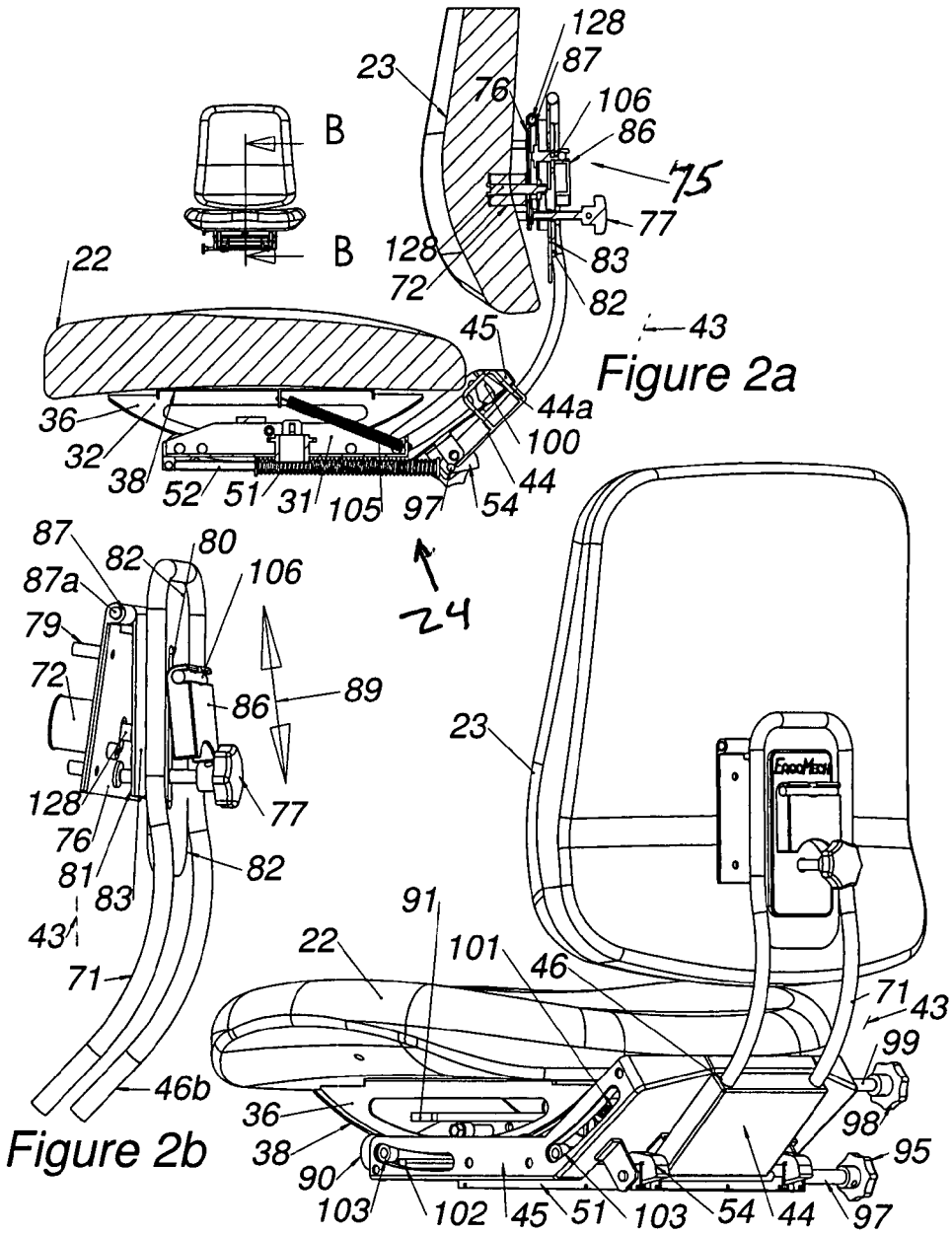
FIG. 2 is details of construction with slightly enlarged view of the seat assembly of FIG. 1 with the back cover and seat mechanism cover removed.
FIG. 2*a* is a section view along the lines bb showing the upright hinge and mounting means assembly with seat depth and backrest angle assemblies and the spring tension force control adjuster assembly.
FIG. 2*b* is a frontal right perspective view along the lines bb showing the upright hinge and mounting means assembly with seat depth and backrest angle assemblies.

One embodiment for mounting of backrest 23 by mounting assembly 24 can best be understood by reference to FIG. 2. Thus, mounting assembly 24 of the present invention also includes a back support assembly, generally designated 43, which includes structural plate 44. Plate 44 has sleeves 46 that securely receive upright structure 71. Plate 44 is securely pivoted to arcuate back pan support 45 thru pivot 97. Plate 44 is securely controlled relative to the angle between plate 44 and member 45 by a cam assembly adjusted by turn knob 98 as seen in FIG. 2. Also mounted to frame member 31 is a compression spring 51 having an end which engages a piston type spring link 52 that resists the force of the spring when the backrest is loaded by the person. an opposite end which is supported by a rotatably mounted cam 54 is mounted to axle 97 and to control the spring force by rotating control knob 95. As cams 54 push the spring through different phases the force required to decline backrest 23 can be adjusted by the occupant to adjust the amount of force required by the mechanism to maintain in equilibrium the desired angle of recline. Axle 97 for the cam is secured for rotation to base frame 32, as best may be seen in FIG. 2.

It is further preferable in the seat assembly of the present invention to include a backrest tilt adjustment, generally designated 75, and best seen in FIGS. 2*a* and 2*b*. Backrest tilt adjustment assembly 75 is coupled between back support assembly 43 and backrest 23 and is formed for manual adjustment of the angle of the backrest relative to backrest support assembly 43. In the illustrated embodiment, backrest 23 is mounted proximate to hinge back plate 76 through bolt sleeves 79 to mounted plate 81 with a hinge pin receiving sleeve formed into latch 87. As can be seen from FIG. 2*a*, latching member 86 is formed to loop against T-Shaped pin 106 to selectively lock hinge plate 83 against plate 82 that is structurally fixed to upright member 71. Pin 106 is structurally fixed to hinge plate 81 and therefore 83 by a T-Shape crossing pin 106. The slot 80 is dimensioned to allow sliding of hinge assembly 75 up or down, on plate 82 of assembly 43 to manually adjust the height of the headrest relative to the seat. Latch 86 is designed to release when flipped horizontal and is designed to lock hinge assembly 75 when latch 86 is forced down generally vertical by an eccentric sleeve shape formed in it. The backrest is designed to recline by manually turning screw knob 77 which is threaded into plate 81 and pushing against hinge plate 76 best seen in FIG. 2*b*. Hinge assembly 75 has, in addition, spring rubber bushing 72 that is contained at one end by bolt 128 that is threaded into plate 81. Therefore, spring bushing 72 is being spring loaded by plate 76 at one end as screw know 77 is turned inward thus increasing the angle of backrest 23.

It is preferable in the seating assembly of the present invention that armrests 34 also be adjustable as is well know in the art.

Another feature of the present invention is that the location of the radius of the center of curvature of backrest 23, FIG. 2, can be adjusted. Thus, backrest support assembly 43 includes an adjustment assembly, generally designated 71, which is formed for adjustment of the distance between the backrest and the pivotal axis 37. It does this by pivoting the backrest about axle 97 thus increasing the distance between the backrest surface and the front edge of the seat, thereby having the effect of increasing the length of the seat. Additionally, plate 44 is securely formed to axle 97 and it contains sleeves 46 which receive the self-locking straight bottom ends 71*a* to form a rigid assembly with components 44, 46, and 71 as a rigid structure that are adjustably mounted to back pan housing 45 to be adjustable with respect to assembly 43. This adjustment is performed by an assembly composed of turn knob 98 and axle 99 that is fixedly mounted to pivot inside backrest pan housing 45. Axle 99 rotates cam 100 best seen in FIG. 2*a* which displaces bracket 44*a* that is securely formed into plate 44.

Figures 3, 4, 5:
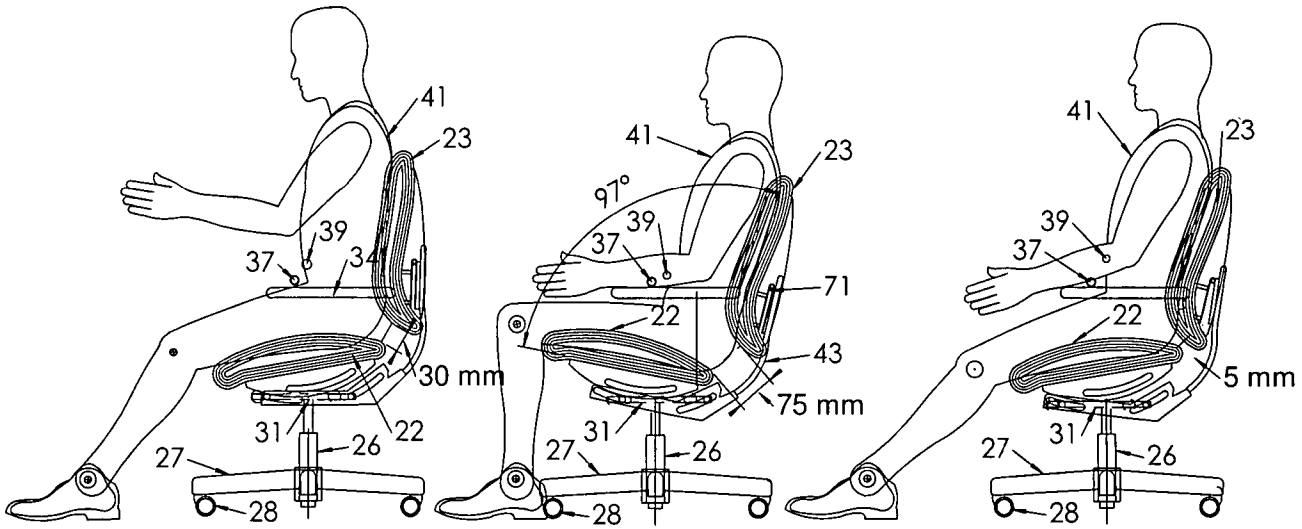
FIGS. 3, 4 and 5 are schematic side elevation views of the seat assembly of FIG. 1 with a user seated on the seat assembly while assuming various postures and showing how the seat and backrest change positions by self adjusting accordingly.

As may be seen in FIGS. 3-5, seat 22 is mounted by arcuate seat pan cradle 36 for pivoting about an axis 37 which is above the seat and proximate the center of mass 39 of a person or user 41 seated on seat 22. By comparing FIGS. 3, 4 and 5, the center of mass 39 of user 41 can be seen to remain closely proximate the center of pivoting 37 of seat cradle 36 for the full range of postures shown in FIGS. 3-5, and in each case the seat pivots from a center of curvature above the seat.

The advantages of having backrest 23 and seat 22 which are both independently movable along arcuate paths having centers of curvature proximate the center of mass of the person seated on the chair, can be seen by comparing the postures which can be achieved in FIGS. 3, 4 and 5. In FIG. 3 an erect posture with a downwardly rotated seat and a near vertical backrest is achieved to allow the pelvis to align the spine with the goal of reducing lumbar stress. In FIG. 4 the seat is pivoted forwardly and upwardly along an arcuate path from FIG. 3, while the backrest is also independently pivoted rearwardly from FIG. 3. The angles of rotation of the seat and back each have their own angle displacement as required by the geometry of the person occupying the seat. In FIG. 5 the seat is only partially rearwardly pivoted, while the backrest also is only partially downwardly pivoted. In each posture center of mass 39 remains in a balanced position proximate the center of pivoting of the seat and backrest. As also can be seen, the spacing between the seat and backrest independently varies with each posture for improved comfort. The mechanism properties allow the user to extend the legs and open the trunk to thigh angle with pelvic rotation increasing the lumbar angle to its mid range position also with the goal of reducing lumbar stress.

Figure 6:
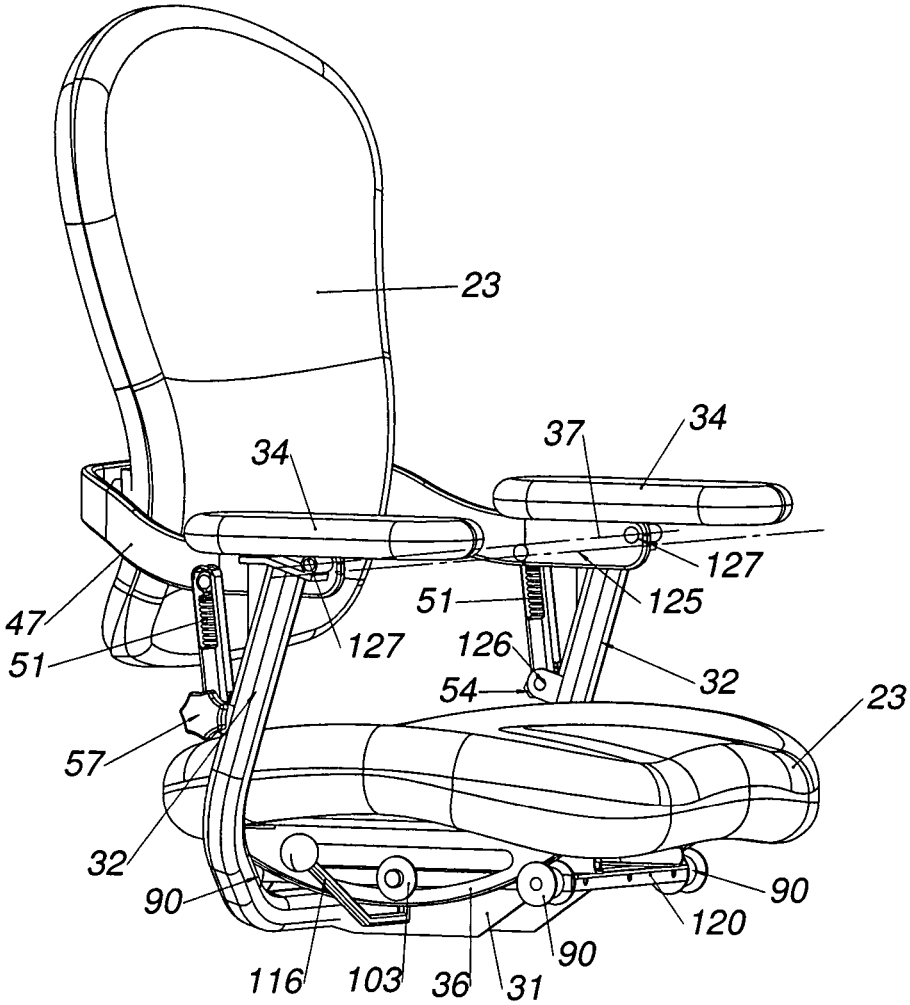
FIG. 6 is an embodiment of alternative structural design and assembly utilizing the seat assembly structure similar to FIG. 1 with rollers under the seat but the backrest motion is supported by a U-Shaped frame support by an upright post supporting the secondary swinging backrest U-Shaped structure extending rearward in a generally horizontal direction. A novel way of adjusting the seat depth by sliding the seat assembly structure fore and aft along a horizontal plane relative to the backrest position. This back depth adjustment functions by sliding the linear cradle rather than adjusting the backrest fore and aft for cases where the backrest is fixed to the seat and base assembly mounting means.

Referring now to the mechanism of seat assembly of FIG. 6, the seat motion is produced by seat pan cradle 36 that is mounted under the seat 23 on rollers 90 at each corner of roller axis support frame 120 that controls the seat motion to rotate about axis 125 as shown by radius 126. Horizontally extending U-Shaped backrest support structure 47 is seen to pivot at axis 37 that is coincident with a pivotal axis mounted pivot pins 127 on U-Shaped frame member 32 which carries the weight of the backrest in back of the user.

Figure 7:
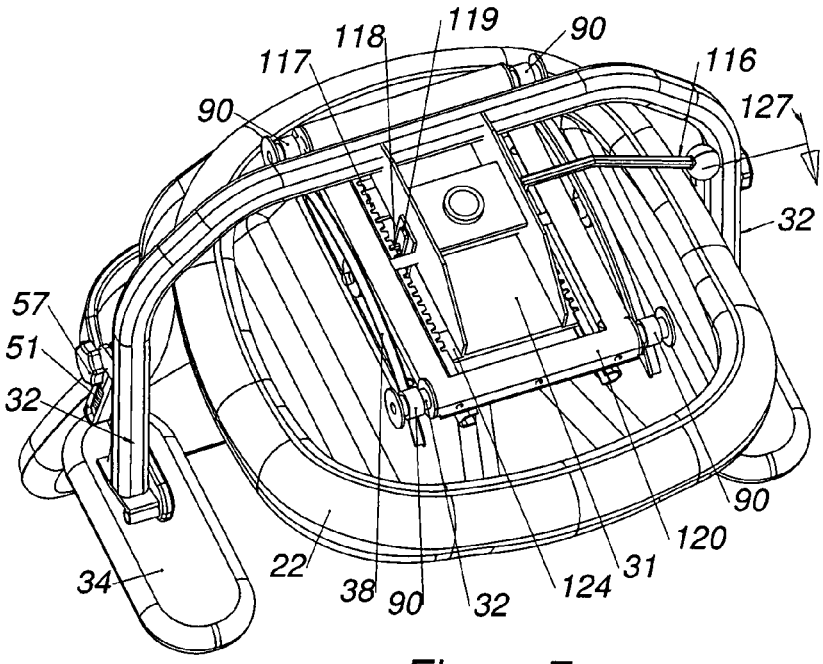
FIG. 7 is the prospective underside view of the mechanism of FIG. 6 with the base assembly removed for clarity.

Referring to FIG. 7, it also can be advantageous to change the radius of pivoting of seat 22 without changing the relative position of the seat. Referring to FIG. 7, showing the underside of assembly in FIG. 6, it can be seen that actual frame assembly 120 is formed to slide and lock in a horizontal extending direction in the fore and aft relative to seat assembly mounting base frame 31. Mounting base frame 31 has two cross members 124 securely fixed that further has slider rectangular member slider 123 fixed to it. Roller frame 120 slides linearly fore and aft on sliding members 123 to move the positions of the seat respect to the backrest. This is what moves the center of the seat 23 fore and aft relative to the center of rotation 125 of the backrest 37 as shown in FIG. 6.

Figure 8A:
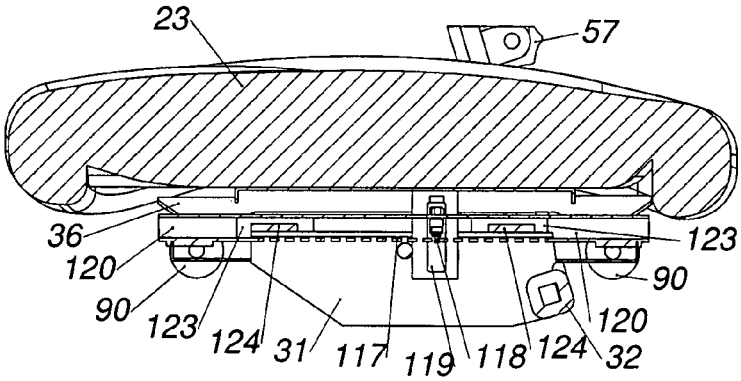
FIG. 8*a* is a cross section of FIG. 8
Figure 8:
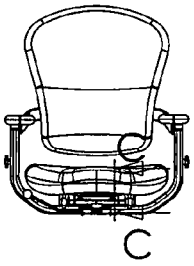
FIG. 8 is frontal view of FIG. 7

As best seen in FIG. 8*a*, roller frame 120 has a longitudinal channel shaped runner end to end that has teeth 117 formed at the bottom edge. These teeth are formed to mate with the tooth 118 formed into plate 119 that is actuated upward out of the way by pushing lever 116 upwards, thus disengaging the lock as shown by arrow 127. After the user locates the preferred distance on the seat from the backrest, the user can push lever 116 downward to lock into teeth 117. This can also be accomplished with a spring that will push lever 116 with a spring force in the direction that locks tooth 118 mating into receiving teeth 117.

While the illustrated embodiment employs a cradle having a center of curvature above the seat, it will be understood that the same arcuate, upwardly concaved seat path can be produced by mounting the seat on an arcuate, upwardly concaved track and supporting the seat on the track by rollers or sliding supports, rather than a pivoted U-shaped cradle. The method of supporting the seat relative to the seat mounting hardware is not critical to the broad statement of the invention which only requires independent movement of the seat and backrest along an upwardly concaved arcuate path, whether a pivoted cradle or track support with rollers or glides is employed.

Figure 9:
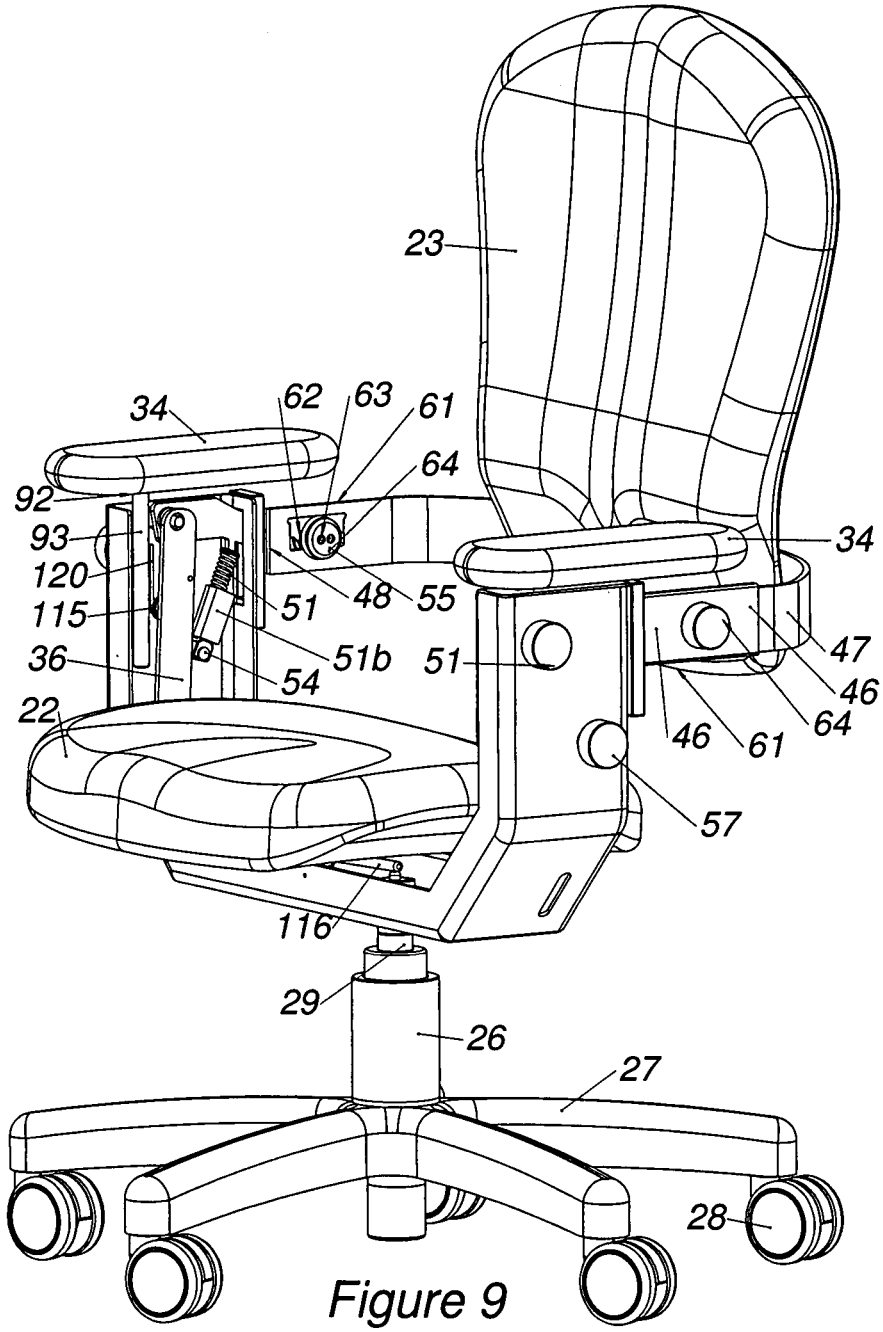
FIG. 9 is a perspective view of another seat assembly in accordance with the present invention but with both the seat and backrest supported by a U-Shaped frame and the seat motion produced by a hanging U-Shaped cradle from the top of the upright armrest post.

One embodiment for mounting of backrest 23 by mounting assembly 24 can best be understood by reference to FIG. 9. Thus, mounting assembly 24 of the present invention also includes a U-shaped back support assembly, generally designated 43, which may include a pair of stub arms 44 having a sleeve 46 secured thereto, for example, by welding, and a U-shaped back strap member 47 with strap ends 48 slidably telescoped inside sleeve 46. As best can be seen in FIG. 9, stub arm portions 44 of the back support assembly 43 are pivoted at pivotal mount 37 to upper end of frame arms 32. Also mounted to frame member 31 is a compression spring 51 having an end which engages a protrusion or tooth 52 on arm stub 44 and an opposite end which is supported by a rotatably mounted cam 53. Axle 54 for the cam is secured for rotation to frame arm 32. Spring 51, therefore, biases back support assembly 43 to essentially the position that is to the point that stub arm 44 engages top member 56 of the U-shaped frame arm.

Rotation in a clockwise direction in FIG. 6 of backrest 23, therefore, is resisted by compression spring 51, and the degree of rotation will depend upon the weight applied to backrest 23 by the user and the spring force in spring 51. Adjustment of the spring force in spring 51 is accomplished by cam 54 which is rotated by the user by turning manually engageable handle 57. Thus, if the user wants to increase the resistance to downwardly extending rotation of backrest 23. The highest position of the cam 54 lifting the spring to a position producing maximum compression of spring 51. If the user wants to reduce the spring force, handle 57 is rotated in a clockwise direction by 90 degrees so that spring 51 can extend an upward biasing force on the back support assembly 43 will be reduced. This eases the resistance to arcuate movement of the backrest.

In FIG. 9 rotation in a counterclockwise direction in of backrest 23, therefore, is resisted by compression spring 51, and the degree of rotation will depend upon the weight applied to backrest 23 by the user and the spring force in spring 51. Adjustment of the spring force in spring 51 is accomplished by rectangular cam 53 which is rotated by the user by turning manually engageable handle 57. Thus, if the user wants to increase the resistance to counterclockwise rotation of backrest 23, handle 57 can be rotated in a counterclockwise direction which rotates square cam 53 by 90 degrees to a position producing maximum compression of spring 51. If the user wants to reduce the spring force, handle 57 is rotated in a clockwise direction by 90 degrees so that spring 51 can extend and upward biasing force on the back support assembly 43 will be reduced. This eases the resistance to arcuate movement of the backrest.

In FIG. 9, end 48 of backrest support strap 47 can be seen to include a rack structure 62 into which a pair of transversely extending pins 63 can be received. Pins 63 are carried by a rotatable knob assembly 64 mounted for rotation to sleeve 46 Rotation of knob assembly 64 in a clockwise direction causes the pins to walk along rack 62 and displace strap 47 forwardly toward U-shaped frame 31. Rotation of knob 46 in a counterclockwise direction displaces strap 47 and backrest 23 in a rearward direction as the pins 63 walk along rack 62. In order to resist unwanted rotation of knob 64 and pins 63 upon application of a rearward force to backrest 23 when the user leans back on the backrest, a detent in the form of protrusions 65 and a notch 55 can be provided on adjustment assembly 61.

The change in the length of back support assembly 43 allows the seat to accommodate users of different sizes with the result that the center of mass 39 for users of different sizes remains proximate the center of pivoting 37 of seat 22 and of backrest 23. Moreover, the change in location in radius of curvature of the path of motion of backrest 23 is not accompanied by a change in the relative position of the center of curvature of the seat and the center of curvature of the backrest. Even for users of the same size, adjustment of the radius of curvature of the backrest may produce a comfort level for a particular user which is enhanced and still will result in positioning of the user's center of mass 39 proximate pivot point 37 for all backrest 23 and seat 22 positions.

It is a further feature of the present invention that chair assembly 21 can be provided with a biasing assembly 110 which biases seat 22 to rotate in a rearward direction. As may be seen in FIG. 2*a*, such biasing can be accomplished by springs 105 mounted in each frame arm between seat cradle 36 and frame arm 32. Although not shown, a biasing adjustment assembly also can be provided, for example, by mounting a cam, such as cam 53, between leg 120 and the frame arm wall. Spring 105 also can be positioned at other radial distances from pivot 37 to vary the movement around the pivot. Biasing of seat 22 rearwardly resists the tendency of the user to slouch or rotate his or her hips forwardly while seated on chair 21.

FIGS. 10-14 show a seat assembly 221 according to another embodiment of present invention. As in the seat assembly 21 described above, base assembly 224 is configured to allow both a seat 222 and a backrest 223 to move about concave paths having their centers curvature above the seat and in front of the backrest, while still permitting for seat 222 movement independent of backrest 223 movement.

Figure 10:
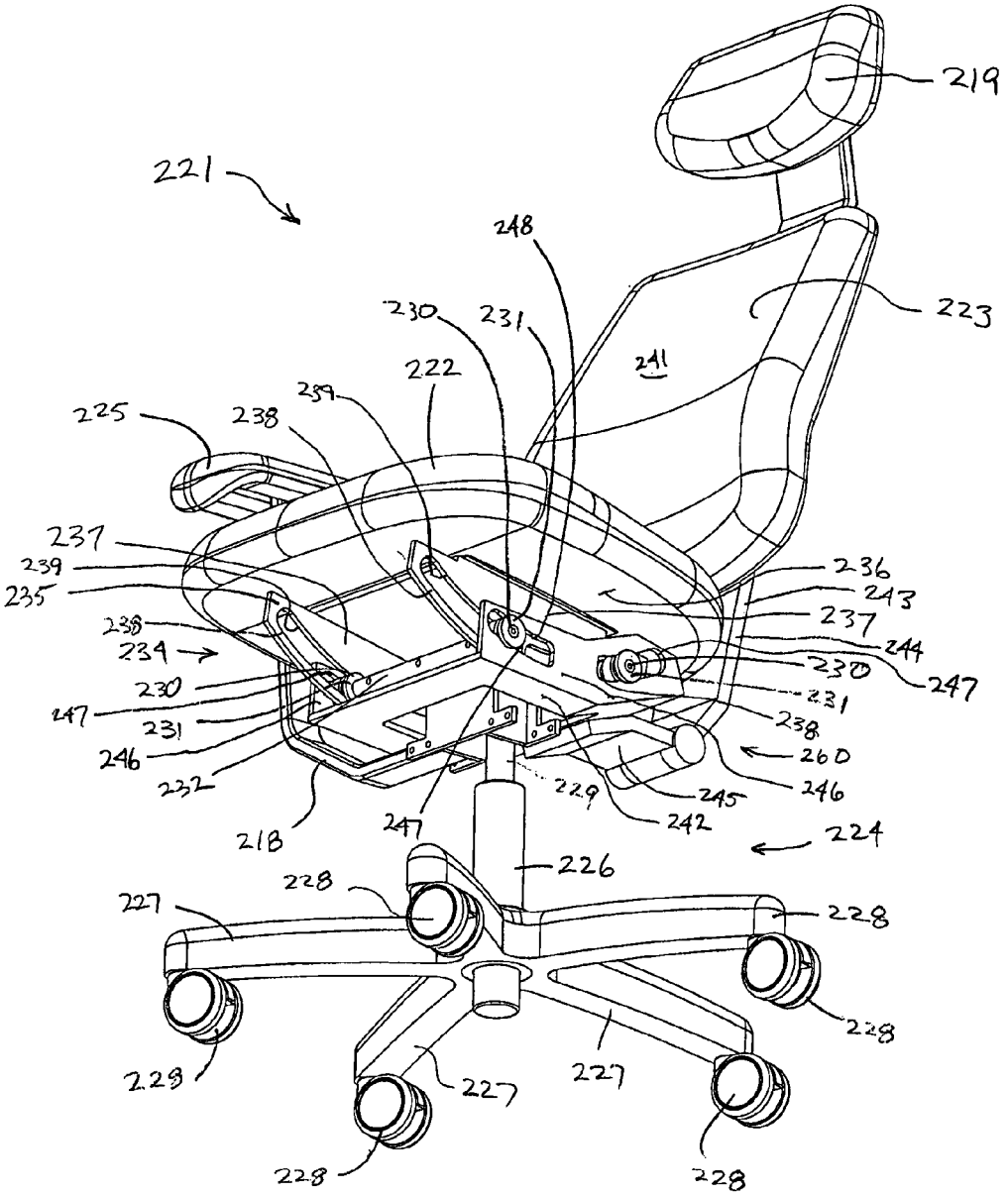
FIG. 10 is a perspective view of another seat assembly in accordance with the present invention.

Turning now specifically to FIG. 10, seat assembly 221 can be seen to include seat 222 and backrest 223 that are supported by a base assembly 224. The base assembly 224 can include a conventional, vertically adjustable, telescope-type, pedestal 226 including an upper portion 229 that extends upwardly towards the seat 222 and backrest 223. The base assembly 224 is rollingly supported by a plurality of roller elements 228 mounted to radially extending legs 227 similar to that described above. The details of the lower portion of the seat, 222, seat back 223, base assembly 224, and pedestal 226 are not critical to the operation of the invention. For example, the base assembly 224 need not necessarily be provided with rollers 228. The seat assembly 221 may include a head rest 219 and arm rests 225. In FIGS. 10-14, the left arm rest has been removed to provide better visibility of the relevant features of the invention. The head rest 219 is configured to move with the backrest 223. The arm rests 225 are mounted to the base assembly 224 by mounting arms 218.

The upper portion of the base assembly 224 further includes a set of transversely extending guides 230 that are mounted to the upper portion 229 of the pedestal 226 by a transverse mounting frame 232. The mounting frame 232 can comprise any structure sufficient to secure the guides 230 to the pedestal 226 in the desired position. Preferably the mounting frame 232 will be mounted to swivel on the top portion 229 of the pedestal 226. In the embodiment shown, the guides 230 are bearings in the form of rollers 231 rotatably mounted at opposite ends of the mounting frame 232. In the illustrated embodiment, the guides 230 include two pairs of rollers 231 rotatably mounted on the mounting frame 232 and positioned fore and aft of pedestal 226. One will appreciate, however, that the actual number of rollers 231 may vary. For example, two, three, four or more sets of rollers may be provided. One will also appreciate that other types of guides may be used. For example, the guides 230 may take the form of low-friction blocks or other suitable means which provide a sliding guide surface, as will become apparent below. Furthermore, one will appreciate that a combination of rollers and other suitable means may also be used.

A seat mounting assembly 234 is used to slidably mount the seat 222 to the base assembly 224 for movement relative to the base assembly 224 along an upwardly concave path. Preferably the seat 222 will have an upper, or seating, surface 233 (see, e.g., FIG. 12) that is generally upwardly facing and in a horizontal orientation, but will tilt fore and aft as it slides along its concave path. Preferably the seating surface 233 will be contoured to ergonomically match a user's anatomy. A guide engaging frame 235 is provided at a lower surface 236 of the seat 223. In the embodiment shown, the guide engaging frame 235 includes a pair of downwardly extending flanges 237. Each of the flanges 237 is provided with at least one, and preferably at least two slots 238 that include an upwardly-concave bearing surface 239. The bearing surfaces 239 ride on corresponding rollers 231 that are received within the slots 238. Preferably the rollers 231 are provided with lips that protrude and engage the sides of the flanges 237 in order to retain the rollers 231 on track within the slots 238. In the illustrated embodiment, each flange 237 includes a pair of slots 238, however, one will appreciate that each flange 237 may include one continuous slot, or a plurality of slots which together form the arcuate path. Preferably, a slot 238 is provided for each roller 231 or guide 230 of the base assembly 234 to afford maximum structural integrity.

Figure 12:
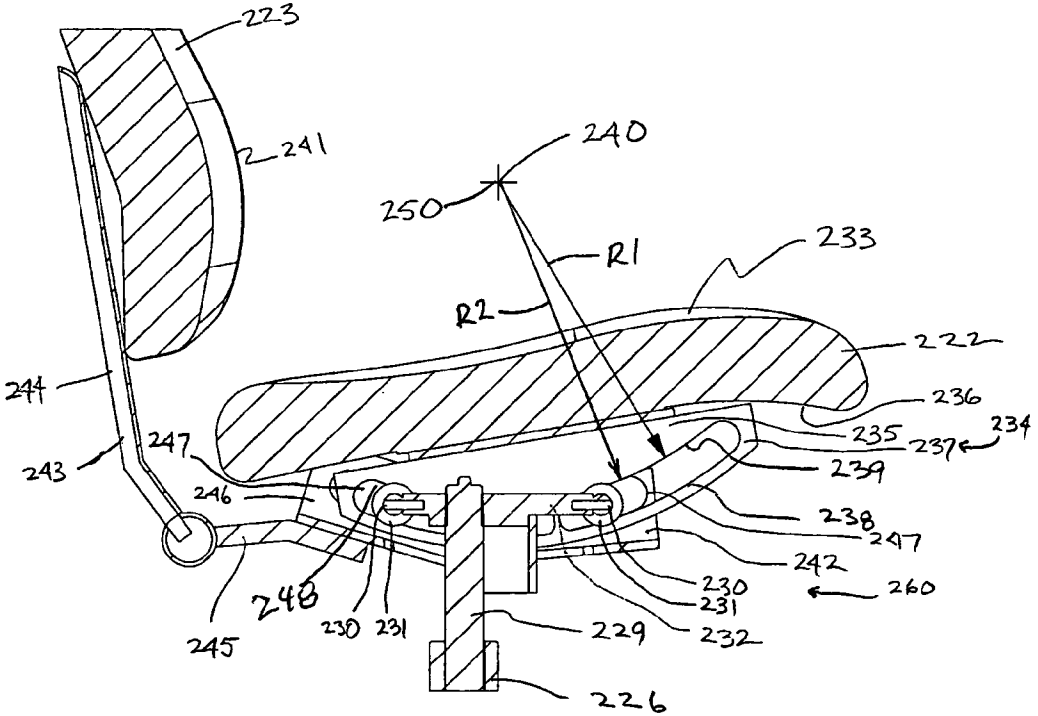
FIG. 12 is an enlarged cross-sectional side view of the seat assembly of FIG. 10 along line 12-12 of FIG. 11.
Figure 11:
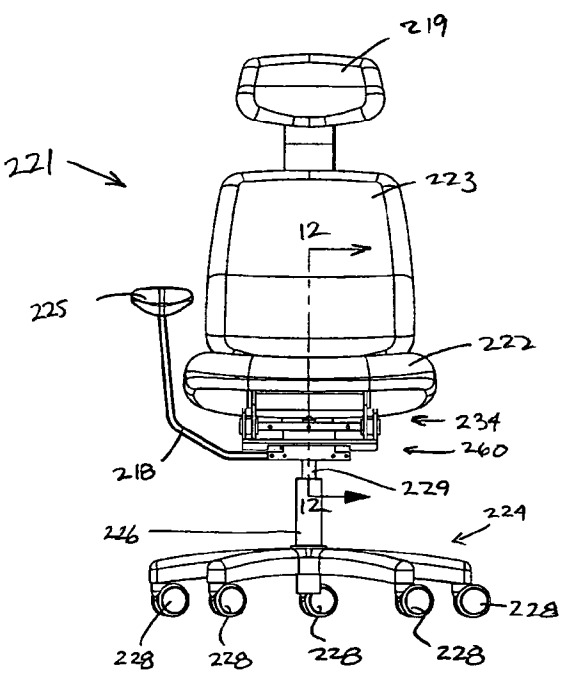
FIG. 11 is a front elevational view of the seat assembly of FIG. 10.
Figure 14:
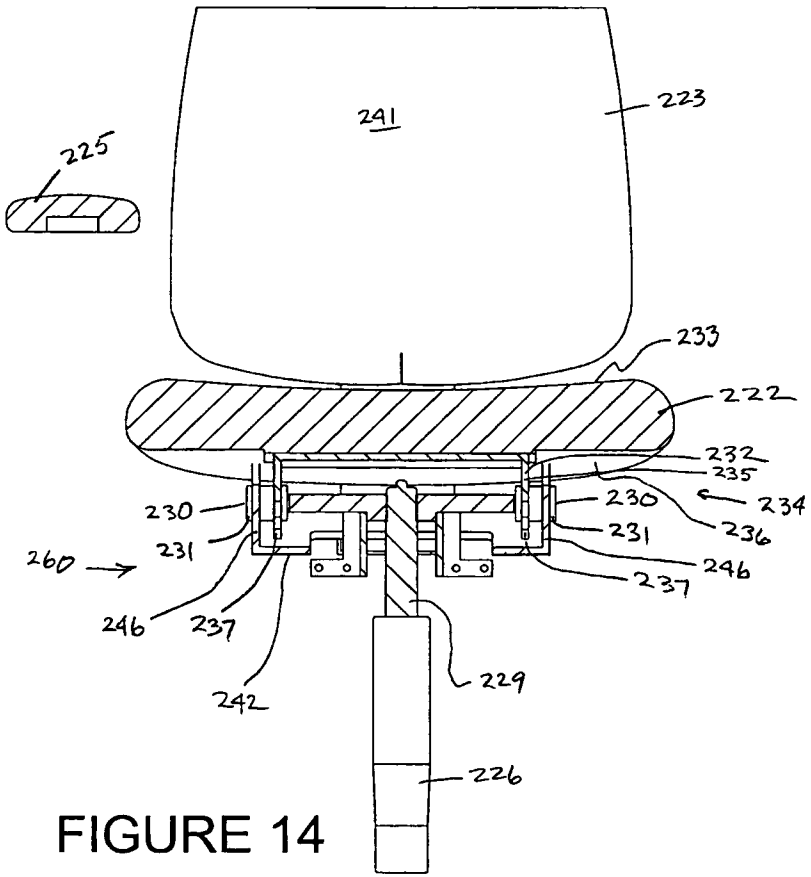
FIG. 14 is an enlarged cross-sectional front view of the seat assembly of FIG. 10 taken along line 14-14 of FIG. 13.
Figure 13:
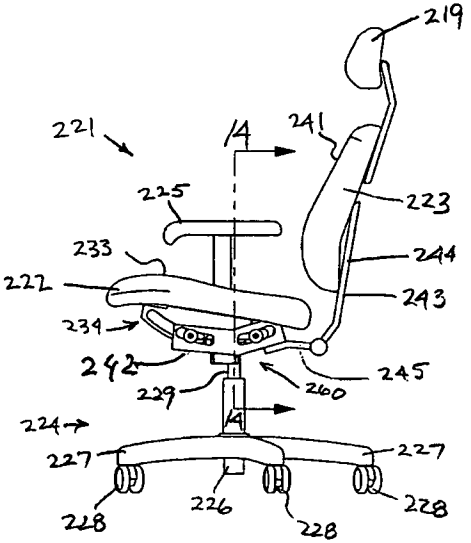
FIG. 13 is a side elevational view of the seat assembly of FIG. 10.

With reference to FIG. 12, the bearing surfaces 239 of the arcuate slots 238 are provided with a radius R1. Preferably the dimension of R1 will be such that the center or axis 240 of the radius R1 is located above the seating surface 233. Accordingly the seat 233 will rock fore and aft about the center of rotation 250. Most preferably, the center of rotation 240 will be located at approximately an expected center of gravity for a user sitting in the seat assembly 221. While not shown in the drawings, it should be appreciated that the shape of the arcuate bearing surfaces 239 could be made compound with a varying curvature such that the center of rotation 240 is not in a single fixed location above seat 223, but is variable depending upon the location of the rollers 231 within the slots 238 and it's curvature.

It should also be appreciated that the structures that form the guides on the base assembly 224 and the structures that form the guide engaging structure on the seat mounting assembly 234 could be reversed. Accordingly, the rollers 231 on the base assembly 224 could be replaced with arcuate slots that are engaged by rollers provided on the guide engaging frame 235. Alternatively, rather than a slot and roller arrangement, the seat 222 could be mounted to the base assembly 224 by pivotal links that are mounted to have an effective center of rotation that is located above the seating surface 233.

A backrest mounting assembly 260 is used to slidably mount the backrest 223 to the base assembly 224 for movement relative to the base assembly 224 along an upwardly concave path. Preferably the backrest 223 will have forward facing back support surface 241 (see, e.g., FIG. 13) that is generally in a vertical orientation, but will tilt fore and aft as the backrest 223 slides along its concave path. Preferably the back support surface 241 will be contoured to ergonomically match a user's anatomy.

The backrest mounting assembly 260 includes a guide engaging frame 242. The backrest 223 is attached to the guide engaging frame 242 by brace 243. The brace 243 is preferably generally L-shaped such that it attaches to the backrest 223 along a generally upright leg 244 and attaches to the guide engaging frame 242 at a generally horizontal leg 245. The angle formed between the upright leg 244 and the horizontal leg 245 may be selectively adjustable by a recliner assembly 336 shown in FIG. 12. Additionally, or alternatively, the junction between the upright leg 244 and the horizontal leg 245 may be resilient to provide a cushioned or springy feel to the backrest 223. It should also be understood that the backrest 223 may be adjustable up and down relative to the upright leg 244 in order to accommodate users of different heights.

The backrest guide engaging frame 242 of the embodiment shown in includes a pair of upwardly extending flanges 246 (FIG. 12). The upwardly extending flanges 246 each include at least one, and preferably at least two slots 247. Each of the slots 247 includes an upper bearing surface 248 having a upwardly-concave shape. The bearing surfaces 248 ride on corresponding rollers 231 that are received within the slots 247. Preferably the rollers 231 are provided with lips that protrude and engage the sides of the flanges 246 in order to retain the rollers 231 on track within the slots 247. In the illustrated embodiment, each flange 246 includes a pair of slots 247; however, one will appreciate that each flange 246 may include one continuous slot, or a plurality of slots which together form the arcuate path. Preferably, a slot 247 is provided for each roller 231 or guide 230 of the base assembly 224 to afford maximum structural integrity.

Accordingly, the backrest 223 will rotate about a center of rotation 250 that is located at a radius R2 (see FIG. 12) from the bearing surface 248 of the slots 247. The center of rotation 250 is preferably located above the seat 222 and in front of the backrest 223. The backrest 223 rotates independently of the seat 223. It should be appreciated that the arcuate slots 247 in the backrest mounting assembly 260 may be formed to have the same curvature as the arcuate slots 238 in the seat mounting assembly 234 such that the backrest 223 and seat 222 share a common center of rotation 240 & 250 near an expected center of gravity of a user as shown in the drawings. Alternatively, the arcuate slots 247 of the backrest mounting assembly 260 could be formed with a different curvature than the seating mounting assembly such that a different center of rotation 250 applies to the backrest 223.

In the embodiment shown, the upwardly extending flanges 246 of the backrest mounting assembly 260 are located adjacent to and outwardly from the downwardly extending flanges 237 of the seat mounting assembly 234. This arrangement could be reversed so that the flanges 246 of the backrest mounting assembly 260 are located inwardly from the flanges 237 of the seat mounting assembly 234. It should also be appreciated that the same centers of rollers 231 may be shared by both the seating mounting assembly arcuate slots 238 and the backrest mounting assembly slots 247. Alternatively, separate rollers 231 may be provided for each of the slots 238 and 247.

It should also be appreciated that the structures that form the guides on the base assembly 224 and the structures that form the guide engaging structure on the backrest mounting assembly 260 could be reversed. Accordingly, the rollers 231 on the base assembly 224 could be replaced with arcuate slots that are engaged by rollers provided on the guide engaging frame 242. Alternatively, rather than a slot and roller arrangement, the backrest 223 could be mounted to the base assembly 224 by pivotal links that are mounted to have an effective center of rotation that is located near an expected center of gravity of a user.

FIGS. 15-19 show a seat assembly 321 according to another embodiment of the present invention. The seat assembly 321 includes base assembly 324 including a pedestal 326 similar to the pedestals 26 and 226 described above. A seat 322 and a backrest 323 are mounted to the base assembly 324 at an upper portion 329 of the pedestal 326 in a manner to permit arcuate sliding movement of the seat 322 and the backrest 323 relative to the base assembly 324. The seat 322 and backrest 323 move independently of each other relative to the base assembly 324. Unlike the seat assemblies described above, the base assembly 324 includes a sliding support 325 on which the seat 322 and backrest 323 are slidably supported.

Figure 15:
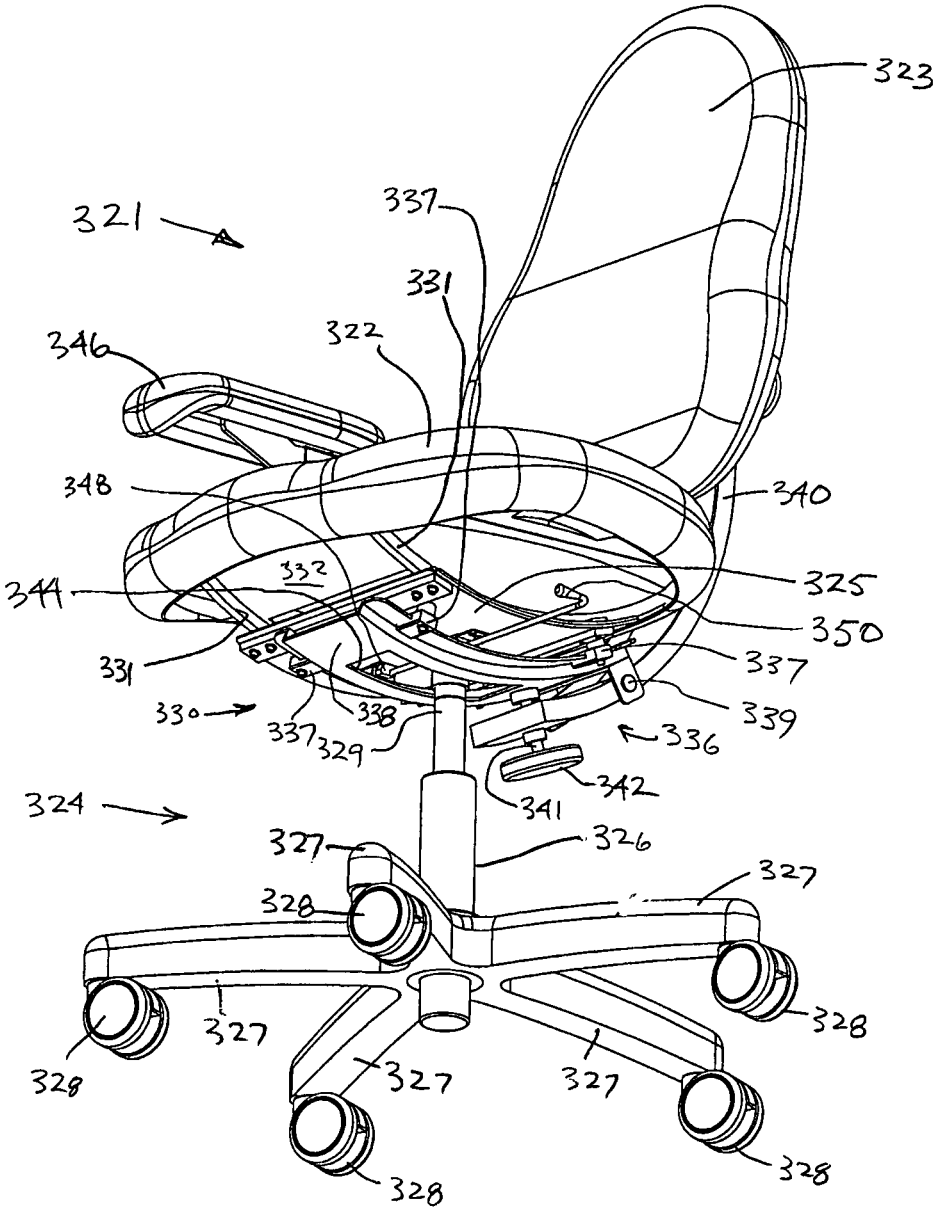
FIG. 15 is a perspective view of another seat assembly in accordance with the present invention.
Figure 16:
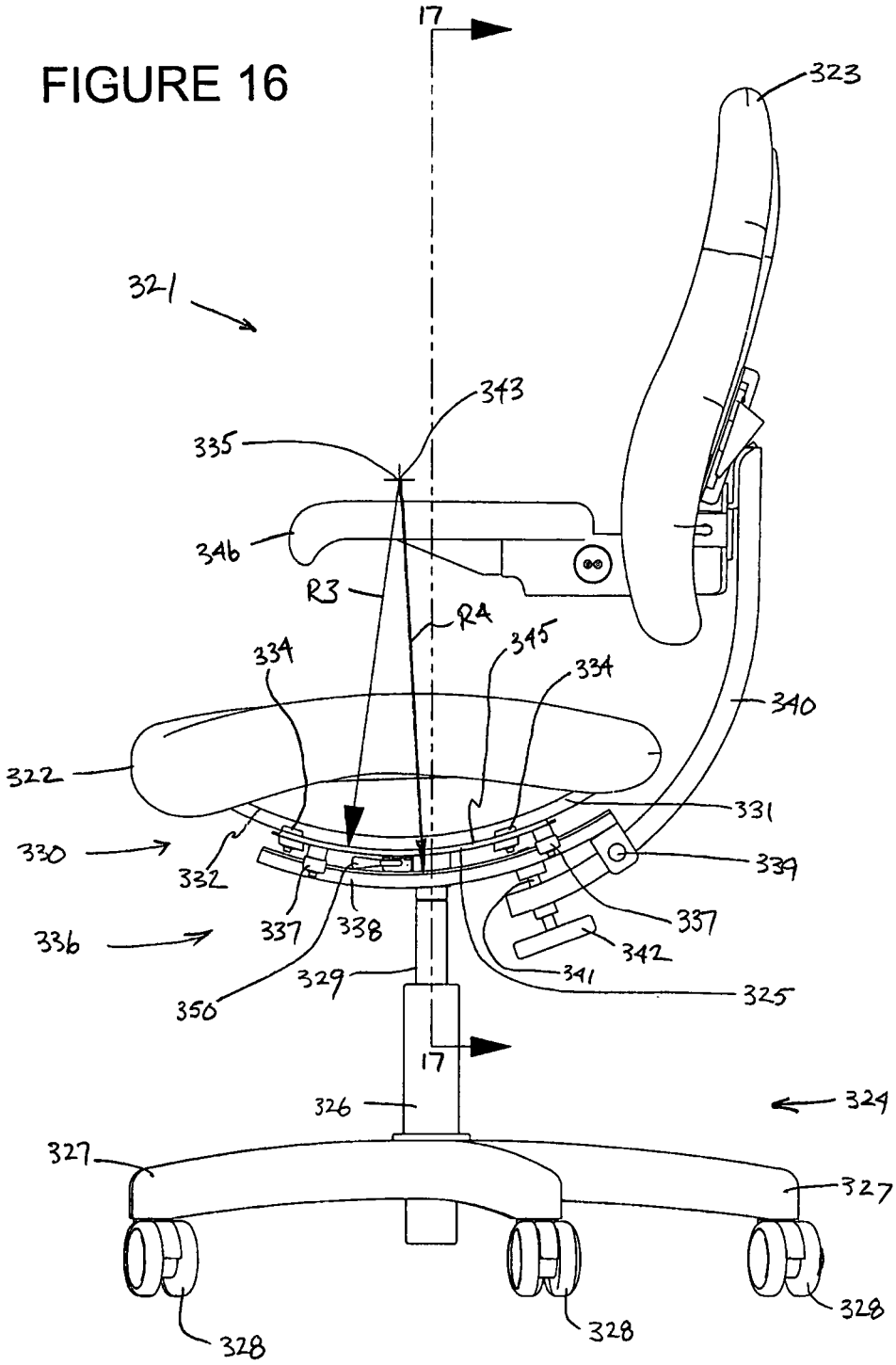
FIG. 16 is a side elevational view of the seat assembly of FIG. 15.
Figure 17:
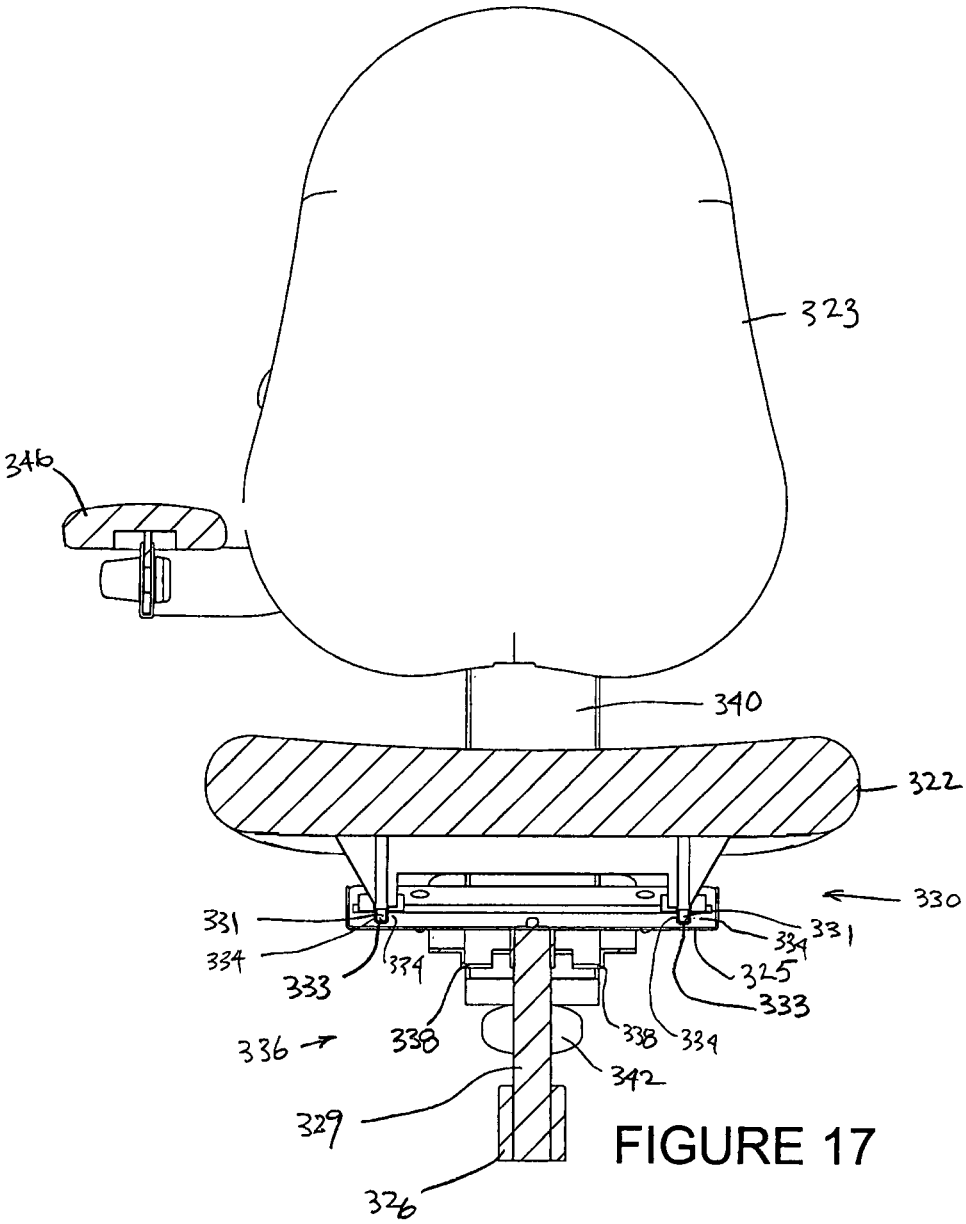
FIG. 17 is a cross-sectional front view of the seat assembly of FIG. 15 taken along line 17-17 of FIG. 16.
Figure 18:
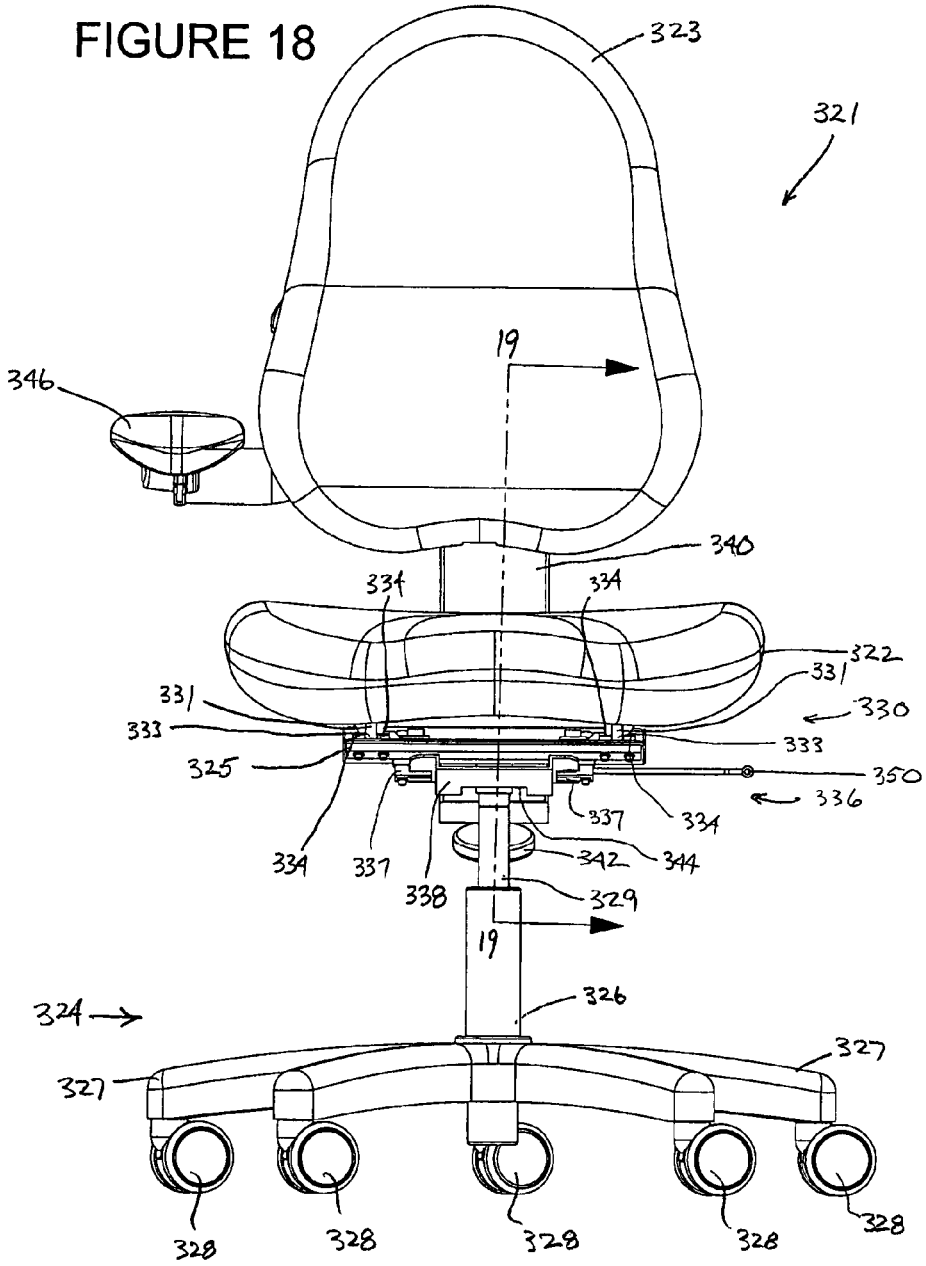
FIG. 18 is a front elevational view of the seat assembly of FIG. 15.

The details of the base assembly 324 are best seen in FIGS. 15 and 16. The base assembly 324 includes the pedestal assembly 326 having an upper portion 329 that extends upwardly towards the seat 322 and backrest 323. The curved sliding support 325 is mounted securely to the upper portion 329 of the pedestal 326 and is generally movable up and down with the telescopic upper portion 329. The curved sliding support 325 may be fixed to the upper portion 329 of the pedestal 326 by bolting, welding, pressure fitted cones or other conventional means. The curved sliding support 325 may take the form of a plate that is curved in one direction so that it has a generally upwardly concave shape in a side profile. Preferably the curved sliding support 325 is formed with a smooth low friction upper surface 345. As is common, the pedestal 326 may include radial legs 327 provided with rollers 328 for rolling support on a support surface.

The seat 322 is mounted to the base assembly 324 by a seat mounting assembly 330. The seat mounting assembly 330 includes a pair of parallel rails 331 provided on a bottom surface 332 of the seat 322. The rails 331 are contoured to match the curvature of the sliding support 325. The rails 331 are constrained within upwardly facing pockets 333 formed by protrusions 334 extending upwardly from the upper surface 345 of the curved sliding support 325. The weight of the seat 322 and a user sitting in the seat 322 will tend to hold the rails 331 in place within the pockets 333. Preferably the rails 331 have a smooth low friction bottom surface that will easily slide within the pockets 333.

Figure 19:
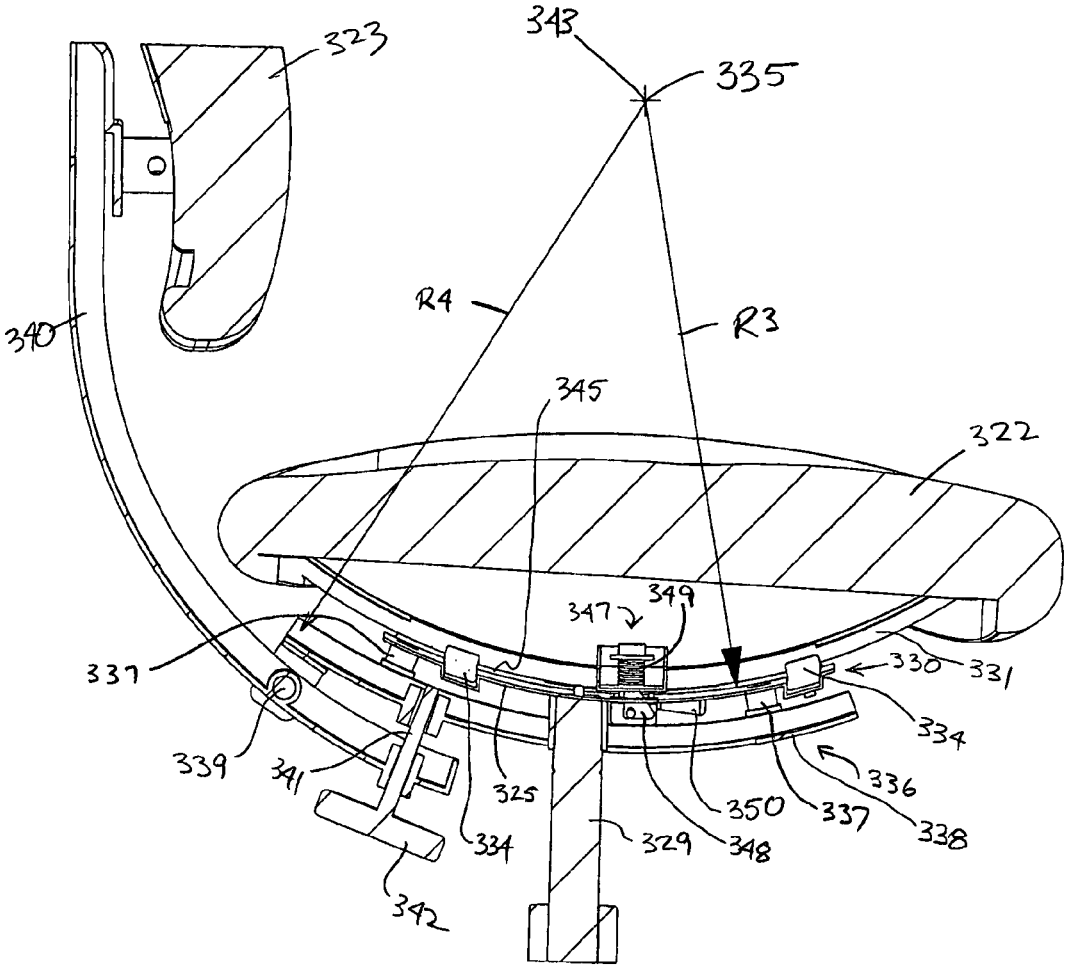
FIG. 19 is an enlarged cross-sectional side view of the seat assembly of FIG. 15 taken along line 19-19 of FIG. 18.

The seat pan 332 will therefore slide along a curved path defined by the curvature of the bottom of rails 331 in contact with the surface 345 of the curved sliding support 325 within pockets 333 of blocks 334. As best seen in FIG. 19, the curved path of the seat pan 332 will have a radius R3 with a center of rotation 335 located over and above the seat 322 in front of the backrest 323. Preferably, though not necessarily, the center of rotation 335 will be located at approximately the expected location of the center of gravity of a user. Accordingly, a user seated on seat 322 will be able to swing fore and aft about their center of gravity while it remains in a fixed orientation relative to the seat 322.

The backrest 323 is mounted to the base assembly 324 by a backrest mounting assembly 336. The backrest mounting assembly 336 includes a plurality of guide brackets 337 that extend downwardly from the curved sliding support 325 to slidingly support and capture the curved edges of a backrest glider 338 beneath the sliding support 325. In the embodiment shown, two pairs of guide brackets 337 are used. Additional pairs of guide brackets 337 may be used to provide additional support. The edges of the backrest glider 338 are upwardly concavely curved. An open portion 344 is provided within the backrest glider 338 through which the upper portion 329 of the pedestal 326 extends.

The backrest glider 338 can slide fore and aft within the guide brackets 337. The curvature of the edges of the backrest glider 338 causes the backrest glider 338 to move along an upwardly concave curved path relative to the base assembly 324 as it slides back and forth within the guide brackets 337. The open portion 344 within the backrest glider 338 permits the backrest glider 338 to move fore and aft without interference from the upper portion 329 of the pedestal 326. The backrest 323 is mounted on a backrest support arm 340, and the backrest support arm 340 connects the backrest 323 with the backrest glider 338, as described in more detail below. Accordingly, as the backrest glider 338 slides fore and aft in the guide brackets 337, the backrest 323 correspondingly moves along an upwardly concave curved path relative to the base assembly 324.

As best seen in FIG. 19, the upwardly concave curved path along which the backrest 323 slides has a radius R4. A center of rotation 343 for the backrest 323 is located generally above and over the seat 322, in front of the backrest 323. Preferably, though not necessarily, the center of rotation 343 for the backrest 323 will be located at approximately the expected level of a user's center of gravity. The backrest 323 moves relative to the base assembly 324 independently from the seat 322.

It is preferable to permit adjustment of the angle of the backrest 323 relative to the backrest glider 338. Therefore, a rear portion of the backrest glider 338 may be provided with a pivot member 339 that pivotally connects a backrest support arm 340 to the backrest glider 338, as shown in FIG. 19. The backrest is connected to and supported on a rear upper portion of the backrest support arm 340. A threaded member 341 including a handle 342 is provided forwardly from the pivot member 339. The threaded member 341 permits adjustment of the distance between the lower end of the backrest support arm 340 and the backrest glider 338. When the lower end of the backrest support arm 340 is drawn close to the backrest glider, the backrest is adjusted towards a more reclined orientation angled away from the seat 322. When the lower end of the backrest support arm 340 is moved away from the backrest glider 338, the backrest is adjusted towards a more upright orientation. Those of skill in the art will be aware of alternative structures for adjusting the angle of the backrest 323 relative to the backrest glider 338. for upwardly concaved arcuate movement of the seat.

A locking mechanism 347 may be included to lock the Seat or the backrest 323 in a fixed orientation relative to the base assembly. The locking mechanism 347 is attached to the support 325 and includes a cam member 348 that can be selectively adjusted to frictionally engage and couple the backrest glider 338 or rails 331 to the sliding support 325. The cam member 348 is biased towards the withdrawn position of FIG. 19 by spring element 349. A lever 350 (best seen in FIG. 15) extends from the cam member 348. The lever 350 can be rotated to move the cam member 348 to an extended position that wedges the cam member 348 between a lower surface of the sliding support 325 and an upper surface of the backrest glider 338 or the lower surface of rails 331. In the extended position, the cam member 348 frictionally couples the backrest glider 338 or the lower surface of rails 331 to the sliding support 325 such that the backrest or seat remains in a fixed orientation relative to the base assembly 324. Preferably the cam member 348 will be in an over-center orientation with respect to the spring element 349 when the cam member is adjusted to the extended position so that the spring element 349 will tend to maintain the cam member 348 in the extended position. The locking mechanism 347 permits the backrest to be adjusted to a desired orientation relative to the base assembly 324 when the cam member 348 is in the withdrawn position, and then maintained in that position by adjusting the cam member 348 to the extended position.

It is further preferable for the backrest 323 to be adjustable relative to the backrest support arm 340. Therefore, the backrest 323 is alternatively mounted for sliding vertical movement along the backrest support arm 340. Furthermore, the backrest 323 may be tiltable relative to the backrest support arm 340. It should be noted that the FIGS. 15-19 show a single arm rest 346 associated with the backrest 323. In practice, two arm rests would generally be used, but the left arm rest has been left out of the drawings to better show the relevant features of the present invention.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A seat assembly comprising:

(a) a seat;

(b) a backrest; and (c) a mounting assembly being formed to support said seat and said backrest for independent movement during use above a mounting frame housing support surface with the mounting assembly being further formed to:

(i) mount said seat in a near horizontal orientation for balanced movement along an upwardly concaved arcuate seat path having a center of curvature for and proximate at the center of mass of a person seated on said seat above the seat and forward of the backrest, and (ii) mount said backrest in a near vertical orientation, for movement independently of said seat along a forwardly concaved arcuate backrest path having a center of curvature for-and proximate at the center of mass of a person seated on said seat above the seat and forward of the backrest, and (iii) mount a biasing assembly to said housing support biasing the back support assembly with the backrest balanced to support an unlocked balanced position located at an angular backrest orientation substantially unrestrained between the range of a near vertical orientation and a substantially reclined backrest position with a person supported at said balanced position, and (iv) mount said mounting assembly for each of said backrest and said seat below a surface of the seat with a curved sliding assembly upwardly concaved rotatably mounted to said frame housing support, said frame housing is further secured on the top end of a seat pedestal.

2. The seat assembly as defined in claim 1, wherein the center of curvature of the arcuate seat path and the center of curvature of the arcuate backrest path are concentric.

3. The seat assembly as defined in claim 1, and an adjustment assembly provided on said mounting assembly and formed to enable adjustment of the radius length of curvature of the arcuate backrest path without changing the positions of the centers of curvature of the seat and the backrest.

4. The seat assembly as defined in claim 1, and an horizontally extending distance adjustment assembly provided on said mounting assembly and formed to enable adjustment of the location of the center of curvature of the arcuate seat path relative to the center of the backrest arcuate path.

5. The seat assembly as defined in claim 1 wherein, said biasing assembly is adjustable as to a force upwardly biasing said backrest support assembly.

6. The seat assembly as defined in claim 1, wherein said backrest support assembly includes an adjustment assembly formed for adjustment of the height of said backrest relative to said backrest support assembly.

7. The seat assembly as defined in claim 1, wherein said backrest includes a backrest tilt adjustment assembly formed for spring loaded fore-and-aft adjustment of the angle of the backrest relative to said backrest mounting assembly.

8. The seat assembly as defined in claim 7, wherein said backrest includes a backrest tilt adjustment assembly coupled to said back support assembly and formed for manual adjustment of the angle of coupling of said backrest relative to said backrest support assembly.

9. The seat assembly as defined in claim 1, wherein said mounting assembly includes:

an upwardly curved rail cradle attached under the seat pivotally mounted to rollers under said seat for movement.

10. The seat assembly as defined in claim 1 wherein said mounting assembly further include armrest assemblies, and armrest adjustment assemblies carried by said armrest assemblies and formed for adjustment of the positions of said armrest assemblies relative to at least one of said mounting assembly supports.

11. The seat assembly as defined in claim 1, wherein a biasing assembly is biasing said seat relative to said support surface.

12. The seat assembly as defined in claim 1, and a locking assembly coupled to said mounting assembly to lock said seat to a fixed position relative to said support surface.

* * * * *